US007918656B2

(12) United States Patent
Hibino et al.

(10) Patent No.: US 7,918,656 B2
(45) Date of Patent: Apr. 5, 2011

(54) SUCTION THROTTLE VALVE OF A COMPRESSOR

(75) Inventors: Sokichi Hibino, Kariya (JP); Shiro Hayashi, Kariya (JP); Masaki Ota, Kariya (JP); Masahiro Kawaguchi, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 667 days.

(21) Appl. No.: 11/982,500

(22) Filed: Nov. 1, 2007

(65) Prior Publication Data

US 2008/0107544 A1 May 8, 2008

(30) Foreign Application Priority Data

Nov. 3, 2006 (JP) ..... P2006-299706

(51) Int. Cl.
*F04B 23/00* (2006.01)
*F04B 41/00* (2006.01)
*F04B 27/08* (2006.01)

(52) U.S. Cl. ..... 417/441; 417/222.2; 417/269; 417/270

(58) Field of Classification Search ..... 417/441, 417/222.2, 269, 270
See application file for complete search history.

(56) References Cited

U.S. PATENT DOCUMENTS

| | | | | |
|---|---|---|---|---|
| 4,801,248 | A * | 1/1989 | Tojo et al. | 417/222.2 |
| 6,257,848 | B1 * | 7/2001 | Terauchi | 417/441 |
| 6,520,751 | B2 * | 2/2003 | Fujita et al. | 417/295 |
| 7,651,321 | B2 * | 1/2010 | Ota et al. | 417/222.2 |
| 2001/0026762 | A1 | 10/2001 | Fujita et al. | |
| 2005/0244279 | A1 | 11/2005 | Murakami et al. | 417/222.2 |
| 2006/0165535 | A1 * | 7/2006 | Ota et al. | 417/222.2 |

FOREIGN PATENT DOCUMENTS

| | | |
|---|---|---|
| DE | 102006005535 | 8/2006 |
| EP | 1122429 B1 | 8/2001 |
| EP | 1591661 A2 | 11/2005 |
| EP | 1696123 B1 | 8/2006 |
| JP | 7-310654 | 11/1995 |
| JP | 11-148457 | 6/1999 |
| JP | 2001-003861 | 1/2001 |
| JP | 2001-289177 | 10/2001 |

OTHER PUBLICATIONS

Supplementary European Search Report of EP 07 11 9745—Dated Jul. 15, 2009.

* cited by examiner

*Primary Examiner* — Devon C Kramer
*Assistant Examiner* — Peter J Bertheaud
(74) *Attorney, Agent, or Firm* — Locke Lord Bissell & Liddell LLP

(57) ABSTRACT

A suction throttle valve of a compressor has a compressor housing having a suction chamber and a crank chamber. The suction throttle valve includes a suction passage formed in the housing, a suction port provided at an inlet of the suction passage, a valve body movably arranged in the suction passage for adjusting opening of the suction passage, an urging member for urging the valve body toward the suction port, and a valve chamber provided in the suction passage. Refrigerant is drawn into the suction passage through the suction port and then received in the suction chamber. A first communication hole is formed through the housing, through which the valve chamber and the suction chamber are in constant communication with each other. A second communication hole is formed through the housing, through which the valve chamber and the crank chamber are in constant communication with each other.

5 Claims, 6 Drawing Sheets

SUCTION THROTTLE VALVE OF A COMPRESSOR

BACKGROUND OF THE INVENTION

The present invention relates to a suction throttle valve of a compressor for use, for example, in an automotive air conditioning system and, more particularly, to a suction throttle valve of a variable displacement compressor for reducing the vibration and noise that are due to pulsation of suction refrigerant gas.

There is generally known a variable displacement compressor for use in an automotive air conditioning system and the like, which is capable of variably controlling its displacement. Such variable displacement compressor will be referred to merely as a "compressor" hereinafter. The compressor often generates noise which is due to pulsation of suction refrigerant produced when the flow rate of suction refrigerant is low. As measures against the development of such noise, some compressors have used a suction throttle valve interposed between the suction port and the suction chamber for changing open area of its suction passage in accordance with the flow rate of suction refrigerant. Japanese Patent Application Publication No. 2000-136776 (hereinafter referred to as the first reference) discloses a compressor having this type of suction throttle valve. In the compressor of the first reference, a gas passage is formed between the suction port and the suction chamber, and a valve working chamber is formed between the gas passage and the suction port. An opening control valve is vertically movably arranged in the valve working chamber. The opening control valve is urged upward by a spring accommodated in a valve chamber which is formed in the valve working chamber. The opening control valve is moved upward or downward thereby to control the open area of the gas passage in accordance with flow rate of refrigerant gas drawn into the suction chamber through the suction port. The valve chamber communicates with the suction chamber through a communication hole and the opening control valve has formed therethrough a hole.

The opening control valve of the compressor according to the first reference is adapted to move upward by the urging force of the spring thereby to reduce the opening of the gas passage when the flow rate of the suction refrigerant is low and the pressure difference between the suction port and the suction chamber becomes small, accordingly. Throttling effect of the opening control valve reduces pulsation of suction refrigerant gas caused by self-excited vibration of the suction valve and generated during operation at a low flow rate of the suction refrigerant. If a spring with a large spring constant is used with an attempt to sufficiently reduce the vibration and noise caused by pulsation of suction refrigerant gas, however, the opening control valve is not sufficiently opened during operation at a high flow rate of suction refrigerant for a higher cooling performance, inviting insufficient comfortability by cooling. This problem occurs more noticeably in a variable displacement compressor which has a wider range of refrigerant flow rate during operation.

In order to solve the above problem, Japanese Patent Application Publication No. 2005-337232 (hereinafter referred to as the second reference) proposes a compressor having a suction port and a suction chamber which are in communication with each other through a suction passage and an opening control valve having a valve working chamber which is formed in the suction passage. The valve working chamber and the suction chamber are connected through a main inlet port and a sub-inlet port which are opened to the inner wall surface of the valve working chamber. A cylindrical valve body is movably arranged in the valve working chamber for adjusting the opening of the suction passage. A valve chamber is provided in the valve working chamber on the lower side of the valve body. The valve chamber communicates with a crank chamber through a communication hole.

In the compressor of the second reference, refrigerant in the crank chamber flows into the valve chamber and the pressure difference between the valve chamber and the suction passage acts on the opening control valve. During operation of the compressor at its maximum displacement, the pressure in the crank chamber is lowered to a level that is substantially the same as that in the suction passage, so that force is not present which urges the valve body of the opening control valve in upward direction which causes the main inlet port to be closed. Therefore, when the flow rate of the refrigerant into the suction chamber through the suction port is increased, the valve body moves downward in the valve working chamber thereby to fully open the main inlet port. On the other hand, when the compressor is operating at an intermediate displacement between the maximum and minimum displacements, the pressure in the crank chamber is increased to a level that is higher than that in the suction passage, so that the valve body is urged in upward direction which causes the main inlet port to be closed and, therefore, the opening of the suction passage is restricted or throttled. In this case, damping effect against the vibration and noise development is increased in accordance with the pressure in the crank chamber.

In the compressor of the second reference, although the pressure in the crank chamber is increased particularly during operation at a low flow rate of suction refrigerant and the damping effect is increased, accordingly, the opening of the suction passage is restricted more than necessary due to the excessively high pressure in the crank chamber. Therefore, necessary flow rate of refrigerant gas is not obtained, which makes it hard for the compressor to maintain its intended performance in accordance with the operating condition of the compressor.

The present invention is directed to a suction throttle valve of a compressor which reduces vibration and noise developed by pulsation of suction refrigerant and maintains the intended performance of the compressor for the entire range of flow rate of suction refrigerant.

SUMMARY OF THE INVENTION

In accordance with an aspect of the present invention, a suction throttle valve of a compressor has a compressor housing having a suction chamber and a crank chamber. The suction throttle valve includes a suction passage, a suction port, a valve body, an urging member, a valve chamber, a first communication hole and a second communication hole. The suction passage is formed in the housing. The suction port is provided at an inlet of the suction passage, through which refrigerant is drawn into the suction passage and then received in the suction chamber. The valve body is movably arranged in the suction passage for adjusting opening of the suction passage. The urging member urges the valve body toward the suction port. The valve chamber is provided in the suction passage. The urging member is disposed in the valve chamber. The first communication hole is formed through the housing, through which the valve chamber and the suction chamber are in constant communication with each other. The second communication hole is formed through the housing, through which the valve chamber and the crank chamber are in constant communication with each other.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
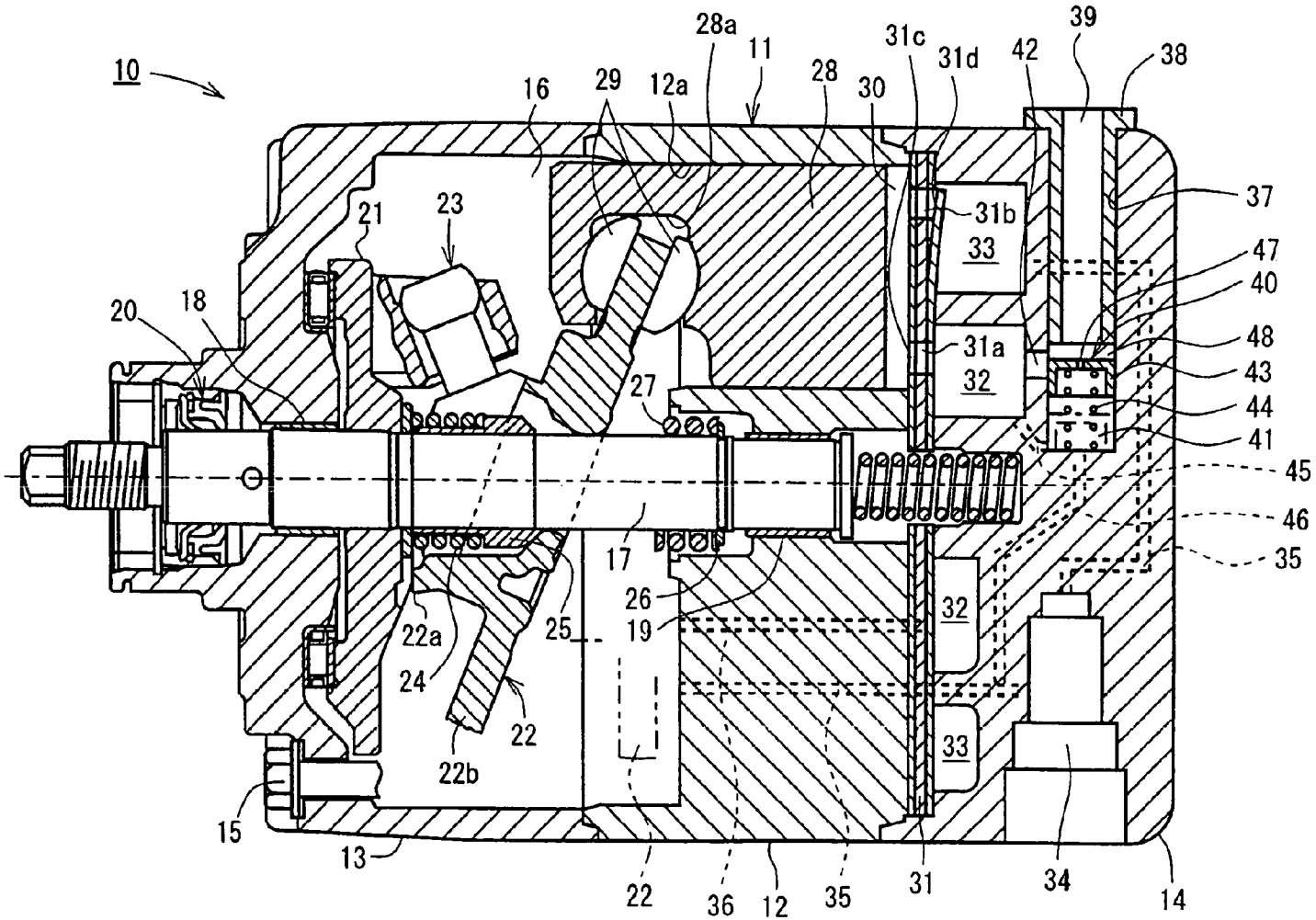
FIG. 1 is a longitudinal sectional view showing a compressor according to a first embodiment of the present invention.

The following will describe a suction throttle valve of a compressor according to the first embodiment of the present invention as embodied in a variable displacement swash plate compressor (hereinafter referred to merely as "compressor") with reference to FIGS. 1 through 3C. Referring to FIG. 1, the compressor 10 has a housing 11 or a compressor housing as an outer shell of the compressor 10. The left-hand side and the right-hand side of the compressor 10 as viewed in FIG. 1 correspond to the front and rear of the compressor 10, respectively. The housing 11 includes a cylinder block 12, a front housing 13 joined to the front end of the cylinder block 12, and a rear housing 14 joined to the rear end of the cylinder block 12. The front housing 13, the cylinder block 12 and the rear housing 14 are fastened together by a plurality of bolts 15 (only one being shown in FIG. 1) inserted through the front housing 13, the cylinder block 12 and the rear housing 14.

The front housing 13 and the cylinder block 12 cooperate to define a crank chamber 16 through which a drive shaft 17 extends. The drive shaft 17 is rotatably supported by a radial bearing 18 and a radial bearing 19 which are provided at the respective centers of the front housing 13 and the cylinder block 12. A shaft seal mechanism 20 is provided on the drive shaft 17 at a position forward of the radial bearing 18 in sliding contact with the outer circumferential surface of the drive shaft 17. The drive shaft 17 is connected at its front end to an external drive source (not shown) through a power transmission mechanism (not shown).

A lug plate 21 is fixed to the drive shaft 17 in the crank chamber 16 for rotation therewith. A swash plate 22 as a part of the displacement changing mechanism of the compressor is provided behind the lug plate 21 and supported by the drive shaft 17 so as to be slidable in the axial direction of the drive shaft 17 and also inclinable relative to the axis of the drive shaft 17. A hinge mechanism 23 is provided between the swash plate 22 and the lug plate 21, through which the swash plate 22 is connected to the lug plate 21 so that the swash plate 22 is synchronously rotatable with the lug plate 21 and inclinable relative to the drive shaft 17.

A coil spring 24 is disposed on the drive shaft 17 between the lug plate 21 and the swash plate 22. A sleeve 25 is slidably disposed on the drive shaft 17 and urged rearward by the coil spring 24. The sleeve 25 in turn urges the swash plate 22 rearward or in the direction which causes the inclination angle of the swash plate 22 to be decreased. It is noted that the inclination angle of the swash plate 22 refers to an angle made between an imaginary plane perpendicular to the axis of the drive shaft 17 and a flat surface of the swash plate 22.

The swash plate 22 has a stop 22a projecting from the front thereof for determining the maximum inclination angle of the swash plate 22 by contact with the lug plate 21 as shown in FIG. 1. A snap ring 26 is fitted on the drive shaft 17 behind the swash plate 22 and a coil spring 27 is disposed on the drive shaft 17 between the snap ring 26 and the swash plate 22. The minimum inclination angle of the swash plate 22 is determined by the contact of the swash plate 22 with the front of the coil spring 27 restricted by the snap ring 26. In FIG. 1, the swash plate 22 indicated by the solid line is positioned at its maximum inclination angle and the swash plate 22, part of the outer peripheral portion of which is indicated by the chain double-dashed line, is positioned at its minimum inclination angle.

The cylinder block 12 has formed therethrough a plurality of cylinder bores 12*a* (only one being shown in FIG. 1) and a single headed-piston 28 is reciprocally slidably received in each cylinder bore 12*a*. Each piston 28 has formed at the neck thereof a recess 28*a* for receiving therein a pair of shoes 29. The outer periphery 22*b* of the swash plate 22 is held by and in sliding contact with each pair of shoes 29, as shown in FIG. 1. As the drive shaft 17 is rotated, the swash plate 22 is rotated synchronously therewith while making a wobbling motion in the axial direction of the drive shaft 17, thereby causing the pistons 28 to reciprocate in their cylinder bores 12*a* through the shoes 29.

As shown in FIG. 1, the front end of the rear housing 14 is joined to the rear end of the cylinder block 12 through a valve plate assembly 31. A suction chamber 32 is formed in the rear housing 14 at a radially inner region and a discharge chamber 33 is formed in the rear housing 14 at a radially outer region thereof. The suction chamber 32 and the discharge chamber 33 communicate with a compression chamber 30 in each cylinder bore 12*a* through a suction hole 31*a* and a discharge hole 31*b* formed in the valve plate assembly 31, respectively. The suction hole 31*a* and the discharge hole 31*b* are provided with a suction valve 31*c* and a discharge valve 31*d*, respectively. As the piston 28 moves from its top dead center toward its bottom dead center in operation of the compressor, refrigerant gas in the suction chamber 32 is drawn into the compression chamber 30 through the suction hole 31*a*. As the piston 28 moves from its bottom dead center toward its top dead center, on the other hand, the refrigerant gas which has been drawn in the compression chamber 30 is then compressed to a predetermined pressure and discharged into the discharge chamber 33 through the discharge hole 31*b*.

The compressor 10 has a displacement control valve 34 which is disposed in the rear housing 14 for changing the inclination angle of the swash plate 22 thereby to adjust the stroke of the pistons 28 and hence to control the displacement of the compressor 10. The displacement control valve 34 is arranged in a supply passage 35 which interconnects the crank chamber 16 and the discharge chamber 33 for fluid communication therebetween. A bleed passage 36 is formed in the cylinder block 12 for fluid communication between the crank chamber 16 and the suction chamber 32. The pressure in the crank chamber 16 depends on the relation between the amount of high-pressure refrigerant gas drawn from the discharge chamber 33 into the crank chamber 16 through the supply passage 35 and the amount of refrigerant gas flowing out from the crank chamber 16 into the suction chamber 32 through the bleed passage 36. The relation between these two pressures is adjusted by changing the opening of the displacement control valve 34. Thus, the pressure difference between the crank chamber 16 and the compression chamber 30 through the piston 28 is varied thereby to change the inclination angle of the swash plate 22.

Figure 2:
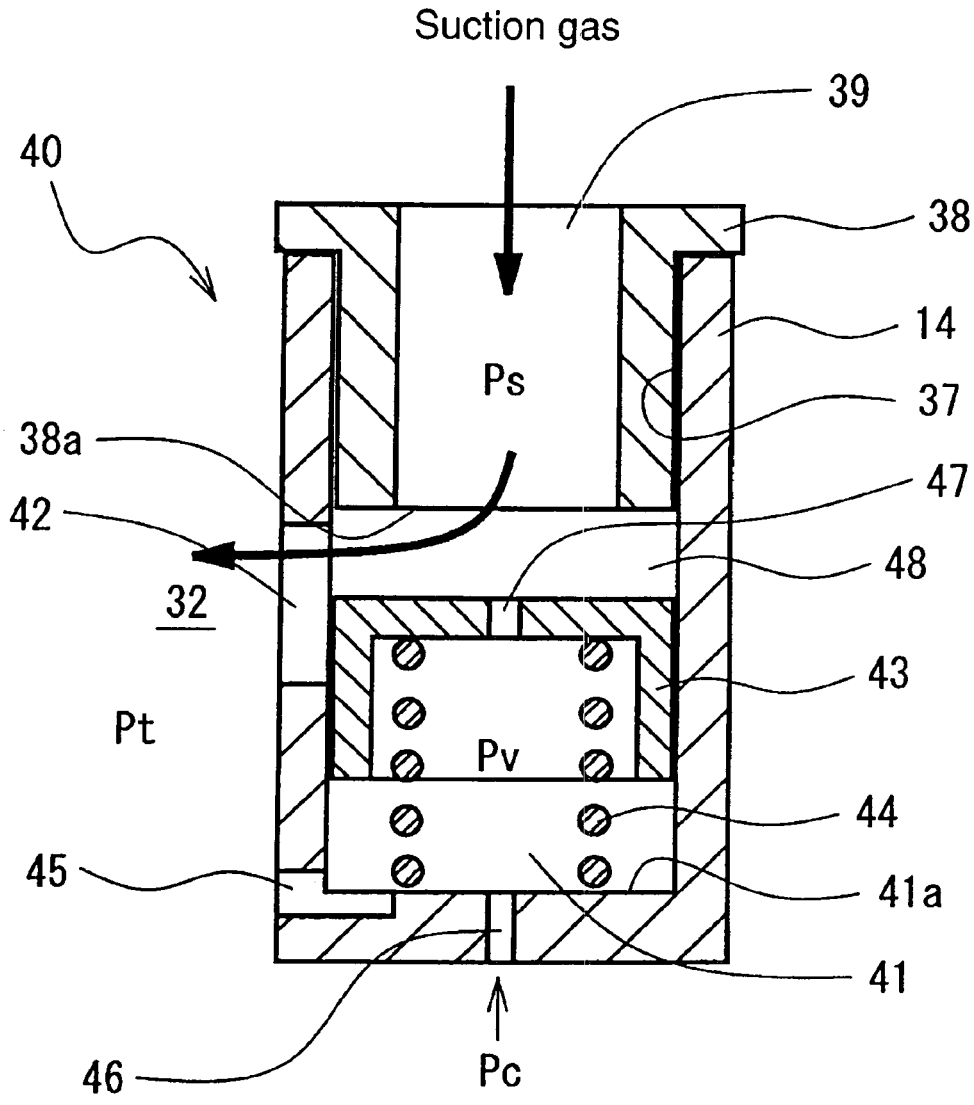
FIG. 2 is an enlarged schematic view showing a major part of a suction throttle valve of the compressor according to the first embodiment.

As shown in FIGS. 1 and 2, a suction throttle valve 40 is arranged in the rear housing 14. The rear housing 14 is formed with a suction passage 37 formed in the shape of a round hole and having an external opening in which a tubular cap 38 is fitted, and a suction port 39 is formed at the inlet of the cap 38. A valve working chamber 48 for the suction throttle valve 40 is formed in the suction passage 37. The valve working chamber 48 and the suction chamber 32 are connected through an inlet port 42 formed through the rear housing 14. A cylindrical valve body 43 is movably arranged in the valve working chamber 48 for adjusting the opening of the suction passage 37. A spring 44 that serves as an urging member is provided in the valve working chamber 48 for urging the valve body 43 toward the suction port 39. The valve working chamber 48 has formed therein a valve chamber 41 in which the spring 44 is disposed. The valve chamber 41 and the suction chamber 32 are in constant communication with each other via a first communication hole 45 formed through the rear housing 14. The valve chamber 41 and the crank chamber 16 are in constant communication with each other via a second communication hole 46 formed through the rear housing 14. The valve body 43 is formed with a hole 47 through which the valve chamber 41 and the suction port 39 communicate with each other.

As shown in FIG. 2, the valve body 43 of the suction throttle valve 40 is movable upward or downward in the valve working chamber 48 thereby to control the open area of the inlet port 42 or the opening of the suction passage 37. That is, when the valve body 43 is moved to its lowermost position where it comes in contact with the bottom 41*a* of the valve working chamber 48, the open area of the inlet port 42 is maximized or the inlet port 42 is fully opened. When the valve body 43 is moved to its uppermost position where it comes in contact with the lower end 38*a* of the cap 38, on the other hand, the open area of the inlet port 42 is minimized or the inlet port 42 is fully closed.

The suction port 39 is connected to the suction side of the external refrigerant circuit (not shown), through which the refrigerant gas in the external refrigerant circuit is drawn into the suction passage 37 and then received in the suction chamber 32. In the following description, the suction pressure at the suction port 39, the suction chamber pressure in the suction chamber 32, the crank chamber pressure in the crank chamber 16, and the valve chamber pressure in the valve chamber 41 will be designated by reference symbols Ps, Pt, Pc and Pv, respectively. The valve body 43 receives at the upper surface thereof opposed to the suction port 39 the suction pressure Ps and at the lower surface thereof opposed to the bottom 41*a* of the valve chamber 41 the valve chamber pressure Pv. The valve body 43 is urged by the spring 44 toward the suction port 39. Therefore, the valve body 43 is moved upward or downward in the valve working chamber 48 according to the resultant force of the resilient force of the spring 44 and the force due to the pressure difference between the suction pressure Ps and the valve chamber pressure Pv.

The second communication hole 46 is made with an open area that is smaller than the sum of open areas of the first communication hole 45 and the hole 47. That is, when the open areas of the holes 46, 45, 47 are designated by the reference symbols A, B1, B2, respectively, the relation between these open areas A, B1 and B2 is expressed by A<B1+B2. The valve chamber 41 communicates with the suction chamber 32, the crank chamber 16 and the suction port 39 through the holes 45, 46 and 47, respectively, so that the valve chamber pressure Pv is an intermediate pressure between the suction pressure Ps and the crank chamber pressure Pc. Because of the above relation A<B1+B2, the valve chamber pressure Pv is more influenced by the suction pressure Ps and the suction chamber pressure Pt, which helps to prevent an excessive increase of the valve chamber pressure Pv due to the crank chamber Pc.

The following will describe the operation of the suction throttle valve 40 of the compressor 10 of the first embodiment.

As the drive shaft 17 is rotated, the swash plate 22 is rotated with a wobbling motion and the piston 28 connected to the swash plate 22 reciprocates in the cylinder bore 12*a*, accordingly. As the piston 28 is moved frontward or leftward as seen in the drawing of FIG. 1, refrigerant gas in the suction chamber 32 is drawn into the compression chamber 30 through the suction hole 31*a* and the suction valve 31*c*. Subsequently, as the piston 28 is moved rearward or rightward as seen in the drawing of FIG. 1, refrigerant gas in the compression chamber 30 is compressed to a predetermined pressure and then discharged into the discharge chamber 33 through the discharge hole 31*b* and the discharge valve 31*d*.

As the opening of the displacement control valve 34 is changed thereby to change the crank chamber pressure Pc in the crank chamber 16, the pressure difference between the crank chamber 16 and the compression chamber 30 through the piston 28 is changed thereby to change the inclination angle of the swash plate 22. Thus, the stroke of the piston 28 and hence the displacement of the compressor 10 is adjusted. For example, as the crank chamber pressure Pc in the crank chamber 16 is lowered, the inclination angle of the swash plate 22 is increased to increase the stroke of the piston 28 and hence the displacement of the compressor 10. As the crank chamber pressure Pc in the crank chamber 16 is raised, the inclination angle of the swash plate 22 is decreased to reduce the stroke of the piston 28 and hence the displacement of the compressor 10.

Figure 3A:
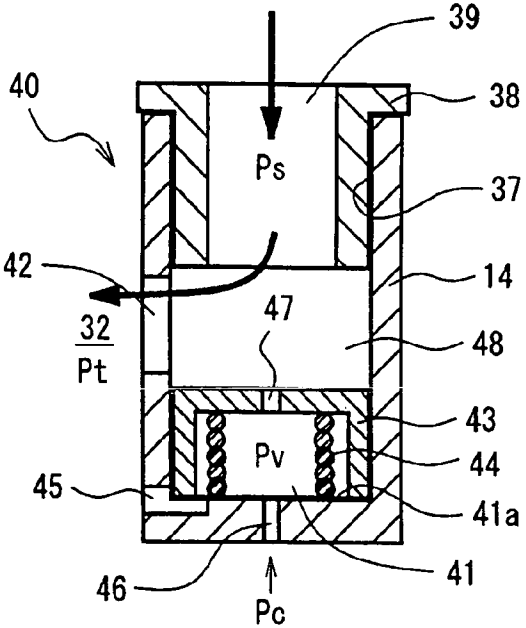
FIG. 3A is a schematic view illustrating the operation of the suction throttle valve at the maximum displacement of the compressor according to the first embodiment.

FIG. 3A shows a state of the suction throttle valve 40 when the inclination angle of the swash plate 22 is maximum and, therefore, the compressor 10 is operating at the maximum displacement. During the maximum displacement operation of the compressor 10, the crank chamber pressure Pc in the crank chamber 16 is lowered to substantially the same pressure as the suction pressure Ps. Also, the valve chamber pressure Pv in the valve chamber 41 becomes substantially the same pressure as the suction pressure Ps (Pc=Pv=Ps). Therefore, the pressure difference between the suction pressure Ps and the valve chamber pressure Pv then acting on the valve body 43 becomes substantially zero. Thus, only the urging force of the spring 44 in effect acts on the valve body 43 to urge toward the suction port 39.

When the refrigerant gas at high flow rate flows from the suction port 39 into the suction chamber 32 through the suction passage 37 thereby to push the valve body 43 toward the bottom 41*a*, the valve body 43 is moved in the valve working chamber 48 toward the bottom 41*a* of the valve working chamber 48 against the urging force of the spring 44 thereby to fully open the inlet port 42. Since the pressure difference is substantially zero and has no influence on the valve body 43 and, therefore, only the urging force of the spring 44 is applied to the valve body 43, the valve body 43 is moved smoothly. Thus, insufficient comfortability by cooling is prevented.

Figure 3B:
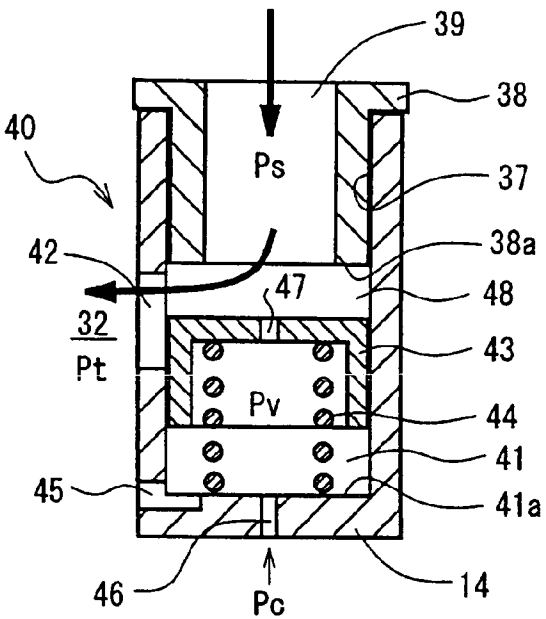
FIG. 3B is a schematic view similar to FIG. 3A, but illustrating the operation of the suction throttle valve at an intermediate displacement of the compressor according to the first embodiment.

FIG. 3B shows a state of the suction throttle valve 40 when the compressor 10 is operating at an intermediate displacement with the swash plate 22 inclined between the maximum and minimum positions. During the intermediate displacement operation of the compressor 10, the crank chamber pressure Pc in the crank chamber 16 is increased higher than the suction pressure Ps. The valve chamber 41 then communicates with the suction chamber 32, the crank chamber 16 and the suction port 39 through the first communication hole 45, the second communication hole 46 and the hole 47, respectively, so that the valve chamber pressure Pv becomes an intermediate pressure between the suction pressure Ps and the crank chamber pressure Pc (Pc>Pv>Ps).

The pressure difference between the suction pressure Ps and the valve chamber pressure Pv, as well as the urging force of the spring 44, is applied to the valve body 43 thereby to push the valve body 43 toward the suction port 39. These forces cause the valve body 43 to be moved in the valve working chamber 48 toward the suction port 39, so that part of the open area of the inlet port 42 is closed thereby to restrict the opening of the suction passage 37. Since the pressure difference between the suction pressure Ps and the valve chamber pressure Pv is applied to the valve body 43 in addition to the urging force of the spring 44, certain damping effect is obtained and pressure fluctuation caused by pulsation of suction refrigerant gas is prevented.

Although the crank chamber pressure Pc becomes considerably high, in particular, during the intermediate displacement operation of the compressor 10, the valve chamber pressure Pv, which is then an intermediate pressure between the suction pressure Ps and the crank chamber pressure Pc, is neither too high nor too low, that is a good pressure providing the damping effect. The opening of the suction passage 37 is not restricted more than necessary. In addition, vibration and noise caused by pulsation of suction refrigerant gas generated during operation at a low flow rate of the refrigerant gas are effectively reduced.

Figure 3C:
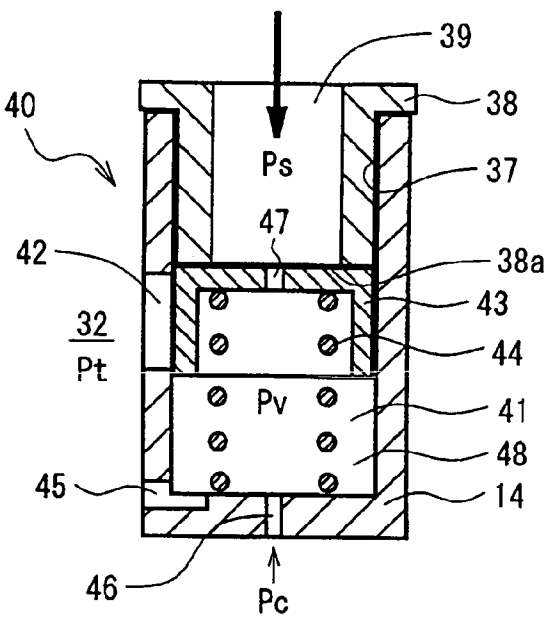
FIG. 3C is a schematic view also similar to FIG. 3A, but illustrating the operation of the suction throttle valve at the minimum displacement of the compressor according to the first embodiment.

FIG. 3C shows a state of the suction throttle valve 40 when the compressor 10 is operating at the minimum displacement with the swash plate 22 inclined to its minimum angle position. During the minimum displacement operation of the compressor 10, the crank chamber pressure Pc in the crank chamber 16 is further increased to its maximum value and becomes considerably higher than the suction pressure Ps. Although the valve chamber pressure Pv in the valve chamber 41 becomes an intermediate pressure between the suction pressure Ps and the crank chamber pressure Pc, the valve chamber pressure Pv becomes considerably higher than that during the intermediate displacement operation of the compressor 10 of FIG. 3B (Pc>Pv>Ps).

The pressure difference between the suction pressure Ps and the valve chamber pressure Pv acts on the valve body 43 in the direction to push the valve body 43 toward the suction port 39, together with the urging force of the spring 44 which urges the valve body 43 in the same direction. These forces cause the valve body 43 to be moved in the valve working chamber 48 toward the suction port 39, so that the valve body 43 is brought into contact with the lower end 38*a* of the cap 38. Therefore, the inlet port 42 is fully closed.

Figure 4:
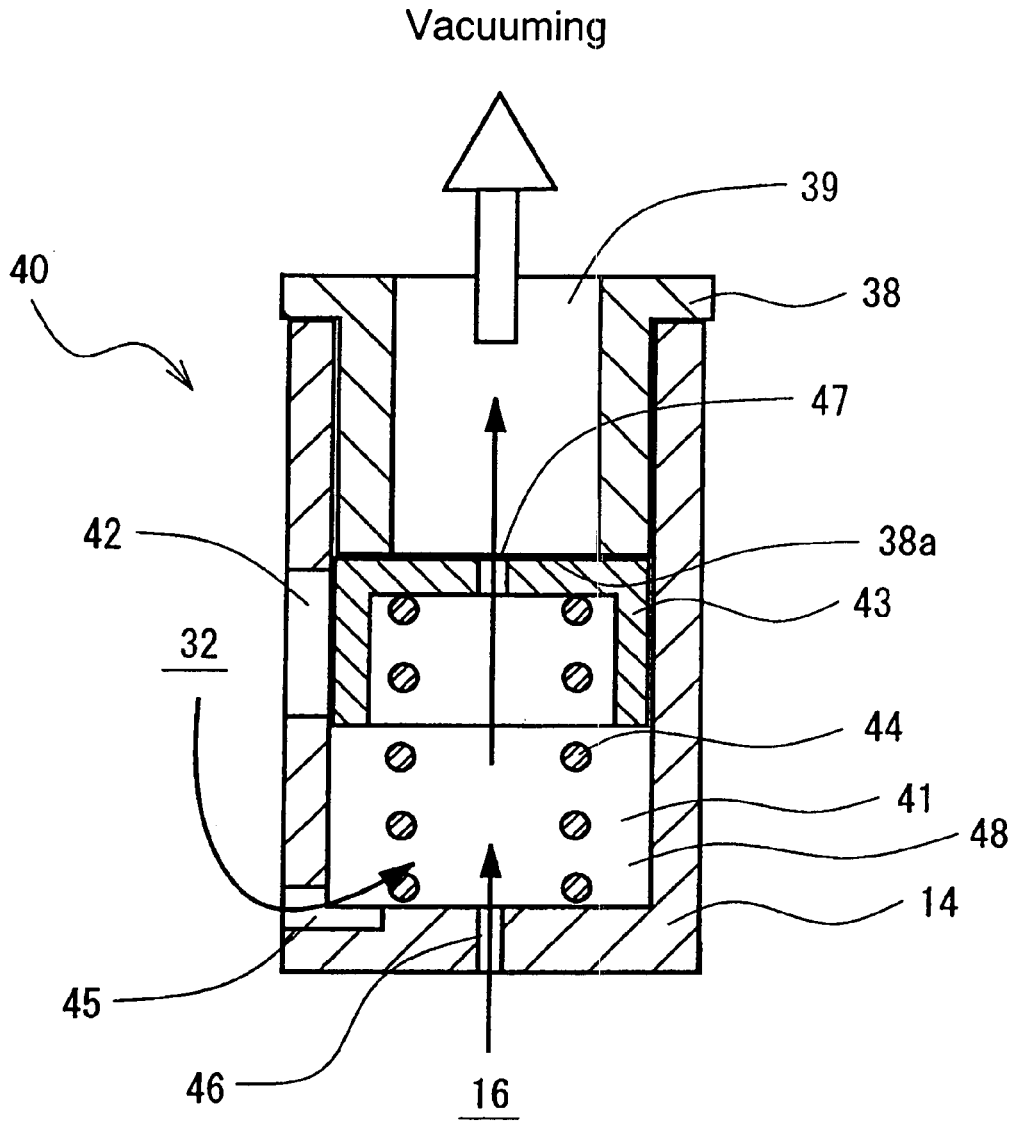
FIG. 4 is a schematic view illustrating the operation of the suction throttle valve during vacuuming of the compressor according to the first embodiment.

As shown in FIG. 4, in vacuuming the refrigerant circuit of the air conditioning system including the compressor 10 before charging the same circuit with refrigerant, the compressor 10 is kept in the stopped state. In this state, the valve body 43 of the suction throttle valve 40 is subjected only to the urging force of the spring 44 and, therefore, the valve body 43 is kept in contact with the lower end 38*a* of the cap 38 and the inlet hole 42 is closed by the valve body 43. The vacuuming of the compressor 10 is performed by a vacuum pump (not shown) connected, for example, to the suction port 39 of the compressor 10. In the present embodiment, the valve chamber 41 communicates with the suction chamber 32, the crank chamber 16 and the suction port 39 through the holes 45, 46 and 47, respectively, so that the suction port 39, to which the above vacuum pump is to be connected, is in communication with the suction chamber 32 and the crank chamber 16. Therefore, vacuuming the compressor 10 through the suction port 39 can exhaust the suction chamber 32 and the crank chamber 16 of any mixture gas and create a vacuum state in the compressor 10.

The suction throttle valve 40 of the compressor according to the first embodiment has the following advantageous effects.

(1) Since the suction throttle valve 40 has the first communication hole 45 which is in constant communication with the valve chamber 41 and the suction chamber 32, and also the second communication hole 46 which is in constant communication with the valve chamber 41 and the crank chamber 16, the valve chamber pressure Pv in the valve chamber 41 becomes an intermediate pressure between the suction pressure Ps in the suction port 39 and the crank chamber pressure Pc in the crank chamber 16, which makes possible effective damping. Although the crank chamber pressure Pc becomes considerably high, in particular, during the minimum displacement operation of the compressor 10 when the flow rate of the suction gas is small, the valve chamber pressure Pv, which is then an intermediate pressure between the suction pressure Ps and the crank chamber pressure Pc, is neither too high and nor too low, that is a good pressure providing the damping effect. Compared to the case where the valve chamber pressure Pv becomes substantially the crank chamber pressure Pc, necessary flow rate of the suction gas is obtained because the opening of the suction passage 37 is not restricted more than necessary, which serves to prevent insufficient comfortability by cooling. In addition, pressure fluctuation caused by pulsation of suction refrigerant gas is prevented and vibration and noise are reduced.

(2) During the maximum displacement operation of the compressor 10 when the flow rate of suction gas is relatively large, the crank chamber pressure Pc in the crank chamber 16 is lowered and becomes substantially the same as the suction pressure Ps. Also, the valve chamber pressure Pv in the valve chamber 41 becomes substantially the same as the suction pressure Ps (Pc=Pv=Ps). Since the pressure difference between the suction pressure Ps and the valve chamber pressure Pv to act on the valve body 43 is substantially zero and only the urging force of the spring 44 acts on the valve body 43, the valve body 43 is smoothly moved toward the bottom 41*a* of the valve chamber 41 against the spring 44, with the result that insufficient comfortability by cooling is prevented. Thus, good performance of the compressor is maintained over the entire range of refrigerant flow rate.

(3) Because the open area A of the second communication hole 46 is set smaller than the sum of the open areas B1 and B2 of the first communication hole 45 and the hole 47 of the valve body 43, respectively, the valve chamber pressure Pv becomes an intermediate pressure between the suction pressure Ps and the crank chamber pressure Pc. Because of the above relation of the open areas of the three holes, the valve chamber pressure Pv is more influenced by the suction pressure Ps and the suction chamber pressure Pt, which helps to prevent an excessive increase of the valve chamber pressure Pv due to the crank chamber pressure Pc.

(4) The valve chamber 41 communicates with the suction chamber 32, the crank chamber 16 and the suction port 39 through the holes 45, 46, 47, respectively, so that the suction port 39 is in communication with the suction chamber 32 and the crank chamber 16. Vacuuming the compressor 10 through the suction port 39 before charging the refrigerant circuit of the air conditioning system including the compressor 10 with refrigerant, the suction chamber 32 and the crank chamber 16 can be exhausted of any mixture gas and an appropriate vacuum state is created in the compressor 10.

Figure 5:
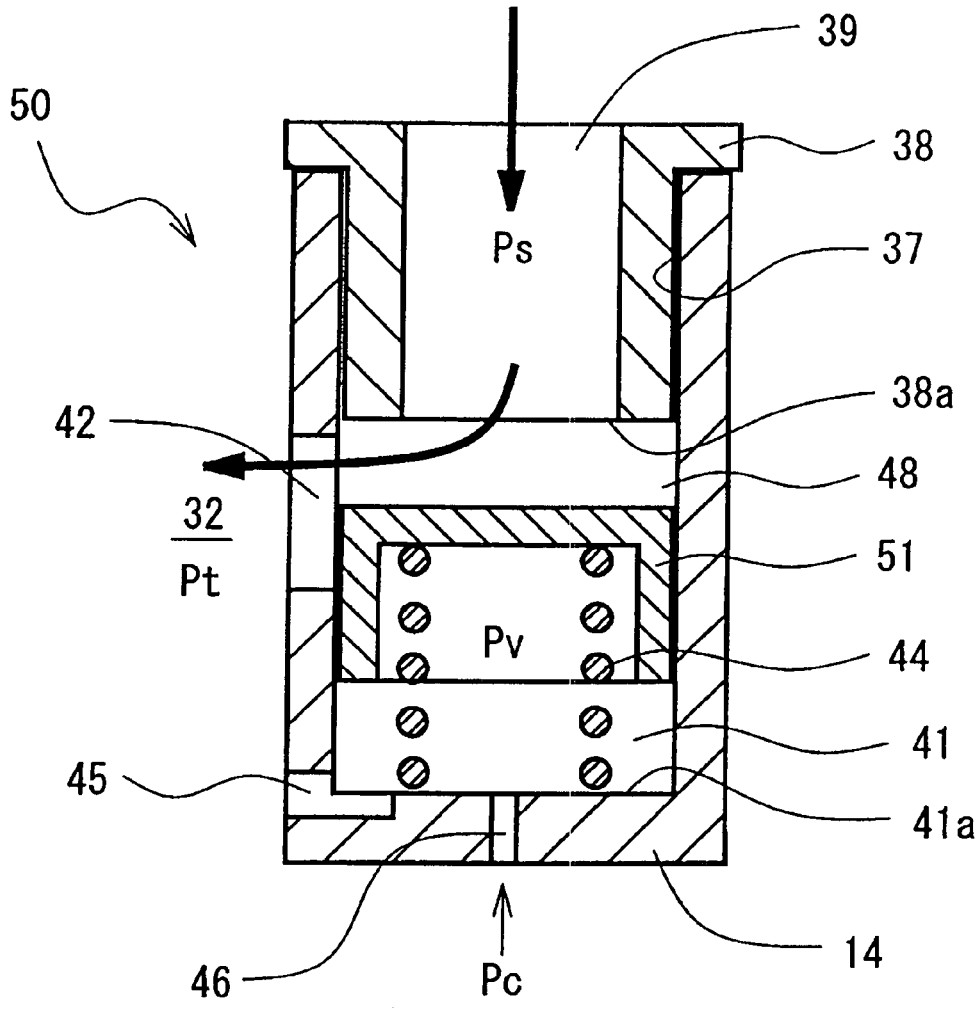
FIG. 5 is an enlarged schematic view showing a major part of a suction throttle valve of a compressor according to a second embodiment of the present invention.

The following will describe a suction throttle valve 50 of the compressor according to the second embodiment of the present invention with reference to FIG. 5. The compressor of the second embodiment differs from that of the first embodiment in that part of the valve body 43 of the first embodiment is modified and the rest of the structure of the compressor of the second embodiment is substantially the same as that of the first embodiment. For the sake of convenience of explanation, therefore, like or same parts or elements will be referred to by the same reference numerals as those which have been used in the first embodiment, and the description thereof will be omitted.

As shown in FIG. 5, the suction throttle valve 50 of the present embodiment has a valve body 51 which is vertically movably arranged in the valve working chamber 48. The valve body 51 of the present embodiment is not formed with a hole such as the hole 47 of the first embodiment. As mentioned earlier, the rest of the structure of the valve body 51 of the second embodiment is substantially the same as the valve body 43 of the first embodiment. The valve chamber 41 communicates with the suction chamber 32 and the crank chamber 16 through the first communication hole 45 and the second communication hole 46, respectively. Because the open area A of the second hole 46 is set smaller than the open area B1 of the first hole 45 (or A<B1), the valve chamber pressure Pv becomes an intermediate pressure between the suction chamber pressure Pt and the crank chamber pressure Pc. Because of the relation of the above two open areas A and B1, the valve chamber pressure Pv is more influenced by the suction chamber pressure Pt, which helps to prevent an excessive increase of the valve chamber pressure Pv due to the crank chamber pressure Pc.

The operation of the suction throttle valve 50 of the compressor according to the second embodiment is basically the same as that of the suction throttle valve 40 of the compressor according to the first embodiment. Therefore, the description of operation of the suction throttle valve 50 will be omitted.

The suction throttle valve 50 of the compressor according to the second embodiment has the following advantageous effects. The same advantageous effects as those mentioned in the paragraphs (1), (2) for the first embodiment are accomplished. The second embodiment offers additional advantages as follows.

(5) Because the open area A of the second hole 46 is set smaller than the open area B1 of the first hole 45 (or A<B1), the valve chamber pressure Pv becomes an intermediate pressure between the suction chamber pressure Pt and the crank chamber pressure Pc. Because of the relation of the above two open areas A and B1, the valve chamber pressure Pv is more influenced by the suction chamber pressure Pt, which helps to prevent an excessive increase of the valve chamber pressure Pv due to the crank chamber pressure Pc.

(6) The valve body 51 which dispenses with a hole helps to reduce the manufacturing cost of the valve body 51.

Figure 6B:
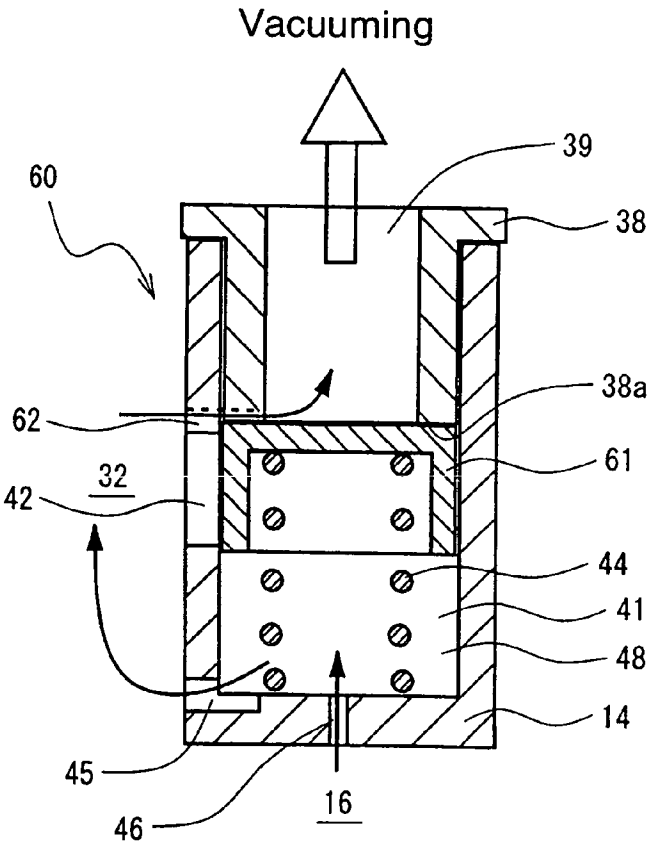
FIG. 6B is an enlarged schematic view similar to FIG. 6A, but showing the major part of the suction throttle valve during vacuuming of the compressor according to the third embodiment.
Figure 6A:
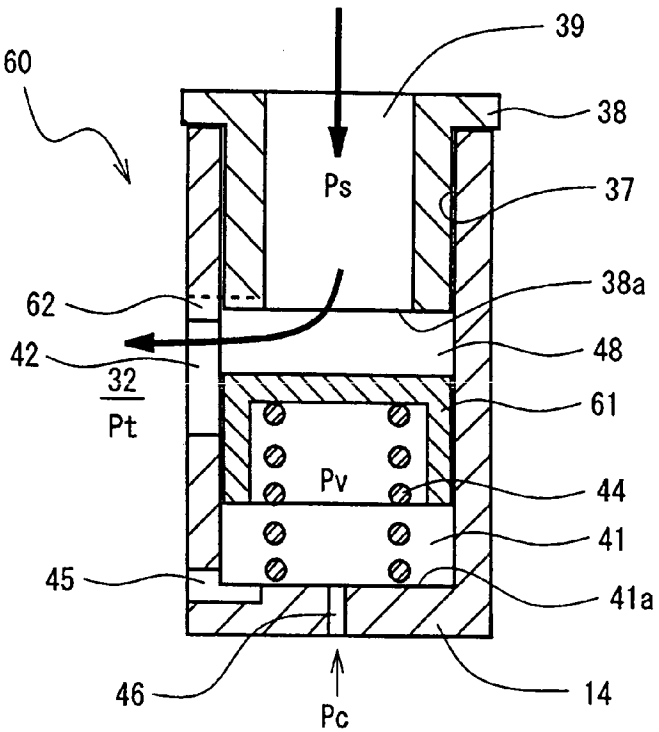
FIG. 6A is an enlarged schematic view showing a major part of a suction throttle valve during the operation of a compressor according to a third embodiment of the present invention.

The following will describe a suction throttle valve of the compressor according to the third embodiment of the present invention with reference to FIGS. 6A and 6B. The compressor of the third embodiment differs from that of the first embodiment in that part of the valve body 43 of the first embodiment is modified and the rest of the structure of the compressor of the third embodiment is substantially the same as that of the first embodiment. For the sake of convenience of explanation, therefore, like or same parts or elements will be referred to by the same reference numerals as those which have been used in the first embodiment, and the description thereof will be omitted.

As shown in FIG. 6A, the suction throttle valve 60 of the present embodiment has a valve body 61 which is vertically movably arranged in the valve working chamber 48. The valve body 61 of the present embodiment is not formed with a hole such as the hole 47 of the first embodiment, but a notch 62 is formed through the rear housing 14 as an additional passage which constitutes a part of the inlet port 42 for constant communication between the suction port 39 and the suction chamber 32. The rest of the structure of the valve body of the third embodiment is substantially the same as that of the first embodiment. The valve chamber 41 communicates with the suction chamber 32 and the crank chamber 16 through the first communication hole 45 and the second communication hole 46, respectively. The suction port 39 is in constant communication with the suction chamber 32 through the notch 62. Because the open area A of the second hole 46 is set smaller than the open area B1 of the first hole 45 (or A<B1), the valve chamber pressure Pv becomes an intermediate pressure between the suction chamber pressure Pt and the crank chamber pressure Pc.

Because of such relation of the above two open areas A, B1, the valve chamber pressure Pv is more influenced by the suction chamber pressure Pt rather than the crank chamber pressure Pc, which helps to prevent an excessive increase of the valve chamber pressure Pv due to the crank chamber pressure Pc.

The operation of the suction throttle valve 60 of the compressor according to the third embodiment is basically the same as that of the suction throttle valve 40 of the compressor according to the first embodiment. Therefore, the description of operation of the suction throttle valve 60 will be omitted. In vacuuming the compressor before charging the refrigerant circuit of the air conditioning system including the compressor with refrigerant, the compressor 10 is kept in the stopped state. In this state, the valve body 61 of the suction throttle valve 60 is subjected only to the urging force of the spring 44, and, therefore, the valve body 61 is kept in contact with the lower end 38*a* of the cap 38 and the inlet hole 42 is closed by the valve body 61, as shown in FIG. 6B. Since the notch 62 is provided in the suction throttle valve 60, however, the suction port 39 and the suction chamber 32 are in communication with each other. When the compressor is vacuumed by a vacuum pump (not shown) connected to the suction port 39, the suction chamber 32 is exhausted of any mixture gas. As indicated by arrow in FIG. 6B, not only the suction chamber 32 but also the crank chamber 16 which communicates with the suction chamber 32 through the valve chamber 41 is exhausted, so that a vacuum state is created in the compressor.

The suction throttle valve 60 of the compressor according to the third embodiment has the following advantageous effects. The same advantageous effects as those mentioned in the paragraphs (1), (2) for the first embodiment are achieved. The third embodiment offers additional advantages as follows.

(7) Because the open area A of the second hole 46 is set smaller than the open area B1 of the first hole 45 (or A<B1), the valve chamber pressure Pv becomes an intermediate pressure between the suction chamber pressure Pt and the crank chamber pressure Pc. Because of the relation of the above two open areas A and B1, the valve chamber pressure Pv is more influenced by the suction chamber pressure Pt, which helps to prevent an excessive increase of the valve chamber pressure Pv.

(8) The suction port 39 is in constant communication with the suction chamber 32 through the notch 62 and the valve chamber 41 is in constant communication with the suction chamber 32 and the crank chamber 16 through the first communication hole 45 and the second communication hole 46, respectively, so that the suction port 39 is in communication with the suction chamber 32 and the crank chamber 16. Therefore, vacuuming the compressor through the suction port 39, the suction chamber 32 and the crank chamber 16 are exhausted and a vacuum state is created in the compressor.

The present invention is not limited to the above-described embodiments, but may be variously modified within the scope of the invention. For example, the above embodiments may be modified as follows.

Although the suction valve of the first through third embodiments uses a reed valve, the suction valve may use a rotary valve instead of the reed valve. In this case, it is possible to prevent pulsation of suction refrigerant gas generated during rotation of the rotary valve.

Although the notch of the third embodiment is formed through the rear housing 14 as an additional passage which constitutes a part of the inlet port 42, the notch may be spaced away from the inlet port 42 if the notch enables the constant communication between the suction port 39 and the suction chamber 32.

Although the spring 44 that serves as the urging member of the first through third embodiments uses a coil spring in the drawings, the urging member may be provided by a disc spring operable to urge the valve body toward the suction port.

Although the open area of the second communication hole 46 of the first through third embodiments is set smaller than the sum of the open areas of the first communication hole 45 and the hole 47, or than the open area of the first communication hole 45, the open area of the second communication hole 46 may be substantially the same as the sum of the open areas of the first communication hole 45 and the hole 47, or as the open area of the first communication hole 45. The open area of the second communication hole 46 may be set larger than the sum of the open areas of the first communication hole 45 and the hole 47.

Therefore, the present examples and embodiments are to be considered as illustrative and not restrictive, and the invention is not to be limited to the details given herein but may be modified within the scope of the appended claims.

What is claimed is:

1. A compressor assembly having a compressor housing, a crank chamber, a suction chamber and a suction throttle valve assembly, the suction throttle assembly comprising:

a suction passage formed in the housing;

a suction port provided at an inlet of the suction passage, through which refrigerant is drawn into the suction passage and then received in the suction chamber;

a valve body movably arranged in the suction passage for adjusting opening of the suction passage, wherein the valve body is formed with a hole;

an urging member for urging the valve body toward the suction port;

a valve chamber provided in the suction passage, wherein the valve chamber and the suction port communicate with each other through the hole of the valve body, the urging member being disposed in the valve chamber;

a first communication hole formed through a wall of the valve chamber, through which the valve chamber and the suction chamber are in constant communication with each other; and a second communication hole formed through a wall of the valve chamber, through which the valve chamber and the crank chamber are in constant communication with each other, wherein the second communication hole is made with an open area that is smaller than the sum of open areas of the first communication hole and the hole of the valve body.

2. The suction throttle valve according to claim 1, wherein the suction passage and the suction chamber are connected through an inlet port formed through the housing.

3. The suction throttle valve according to claim 1, wherein the valve body has a cylindrical shape.

4. The suction throttle valve according to claim 1, wherein the urging member is a spring.

5. The suction throttle valve according to claim 1, further comprising a tubular cap which is fitted in the suction passage, wherein the suction port is formed at an inlet of the cap.

* * * * *